US007563183B2

(12) United States Patent
Kucek

(10) Patent No.: US 7,563,183 B2
(45) **Date of Patent: *Jul. 21, 2009**

(54) BASEBALL PITCHING TRAINING DEVICE

(75) Inventor: Jack Kucek, Canfield, OH (US)

(73) Assignee: Strikeout Strippz LLC, Columbiana, OH (US)

( * ) Notice: Subject to any disclaimer, the term of this patent is extended or adjusted under 35 U.S.C. 154(b) by 75 days.

This patent is subject to a terminal disclaimer.

(21) Appl. No.: 11/705,118

(22) Filed: Feb. 12, 2007

(65) Prior Publication Data

US 2007/0142133 A1 Jun. 21, 2007

Related U.S. Application Data

(63) Continuation-in-part of application No. 11/166,814, filed on Jun. 27, 2005, now Pat. No. 7,244,197.

(51) Int. Cl.
*A63B 69/00* (2006.01)
*A41D 19/00* (2006.01)

(52) U.S. Cl. ..... 473/458; 473/464; 473/422; 473/450

(58) Field of Classification Search ..... 473/422, 473/450, 458, 464, 451, 205, 212, 59; 2/16, 2/19–21, 159, 161.1
See application file for complete search history.

(56) References Cited

U.S. PATENT DOCUMENTS 883,761 A * 4/1908 Taylor ..... 294/25
1,819,048 A * 8/1931 Till ..... 2/19
2,725,561 A * 12/1955 Blepp ..... 2/19
3,152,337 A * 10/1964 Barry ..... 2/159
3,408,657 A * 11/1968 Gallagher ..... 2/159
3,997,159 A 12/1976 Malhas
4,121,824 A * 10/1978 Hirschfield ..... 473/458
4,253,664 A 3/1981 Daulton
4,698,850 A * 10/1987 Patton et al. ..... 2/159
4,753,442 A 6/1988 Bland
4,796,306 A * 1/1989 Mitchell ..... 473/205
5,224,220 A * 7/1993 Andriola ..... 2/160
5,346,208 A * 9/1994 Wood, Sr. ..... 473/464
5,414,868 A * 5/1995 Crawford ..... 2/160
5,435,013 A * 7/1995 Davis ..... 2/161.1
5,687,421 A * 11/1997 Murai ..... 2/19
5,758,805 A * 6/1998 Dunn ..... 223/78
5,876,292 A 3/1999 Hamilton
6,006,358 A * 12/1999 Keating ..... 2/161.1
6,447,464 B1 * 9/2002 Dunlevy et al. ..... 601/40
6,553,576 B1 * 4/2003 Knapp ..... 2/161.6
6,941,578 B2 * 9/2005 Anderson ..... 2/19
7,415,735 B2 * 8/2008 Erickson et al. ..... 2/163
2004/0018899 A1 * 1/2004 Thiruppathi ..... 473/464

* cited by examiner

*Primary Examiner*—Mitra Aryanpour
(74) *Attorney, Agent, or Firm*—Harpman & Harpman

(57) ABSTRACT

A device and method of use in learning, practicing and perfecting a baseball pitching motion comprising, a practice glove worn on the pitching hand having a pair of finger portions and a pair of extending directional indicator elements removably positioned thereon. The indicator elements extending as independent elongated flexible band ribbons attached on the ends of the index finger portion and adjacent finger portion. By practicing the pitching motion, the relative position of the indicator bands will confirm and teach proper pitching arm and hand position through the multiple pitching sequence of the pitching action.

1 Claim, 5 Drawing Sheets

BASEBALL PITCHING TRAINING DEVICE

This is a continuation in part application of Ser. No. 11/166,814, filed Jun. 27, 2005 now U.S. Pat. No. 7,244,197.

BACKGROUND OF THE INVENTION

1. Technical Field

This device and method relates to the teaching of proper baseball pitching techniques to improve the pitching mechanics of the pitcher.

2. Description of Prior Art

Prior art devices of this type are unknown for baseball pitching. A variety of sports related devices have been developed to teach proper sports form and mechanics, see for example U.S. Pat. No. 3,997,159 on a tennis training device that has a weighted flexible tether that is grasped at one end and swung forward using the motion associated with the exaggerated throwing of a baseball to teach the proper arm stroke used in tennis.

U.S. Pat. No. 4,253,664 discloses another tennis training device that uses a pair of weighted elongated pouches attached to a handle at one end.

A baseball glove with an automatic ball return device is claimed in U.S. Pat. No. 4,753,442 that is used with a baseball glove and has a baseball attached to the end of a flexible line. The other end of the line extends from a retractable spool positioned on the backside of a baseball glove.

In U.S. Pat. No. 5,876,292 a golf training aid is disclosed using a clicker which is slidably positioned on an extension element from the golfer's wrist.

Finally, in U.S. Patent Publication US 2003/02110905 A1 a dual purpose child's baseball glove is disclosed having a baseball secured to the end of the resilient tether extending from the ball and attached on the other end to the glove.

SUMMARY OF THE INVENTION

A baseball method and teaching device for pitching in which a specialized sports glove is used by the pitcher to simulate the action of pitching a baseball. The glove has positioning indicator strips removably positioned on two finger portions fingers to provide for a visual indicator of the pitching arm and hand position during the act of pitching. By following a set of method steps the correct arm and hand action position can be taught and confirmed by the resulting positioning of the indicator strips in relation to the pitcher's body.

DETAILED DESCRIPTION OF THE INVENTION

Figure 6:
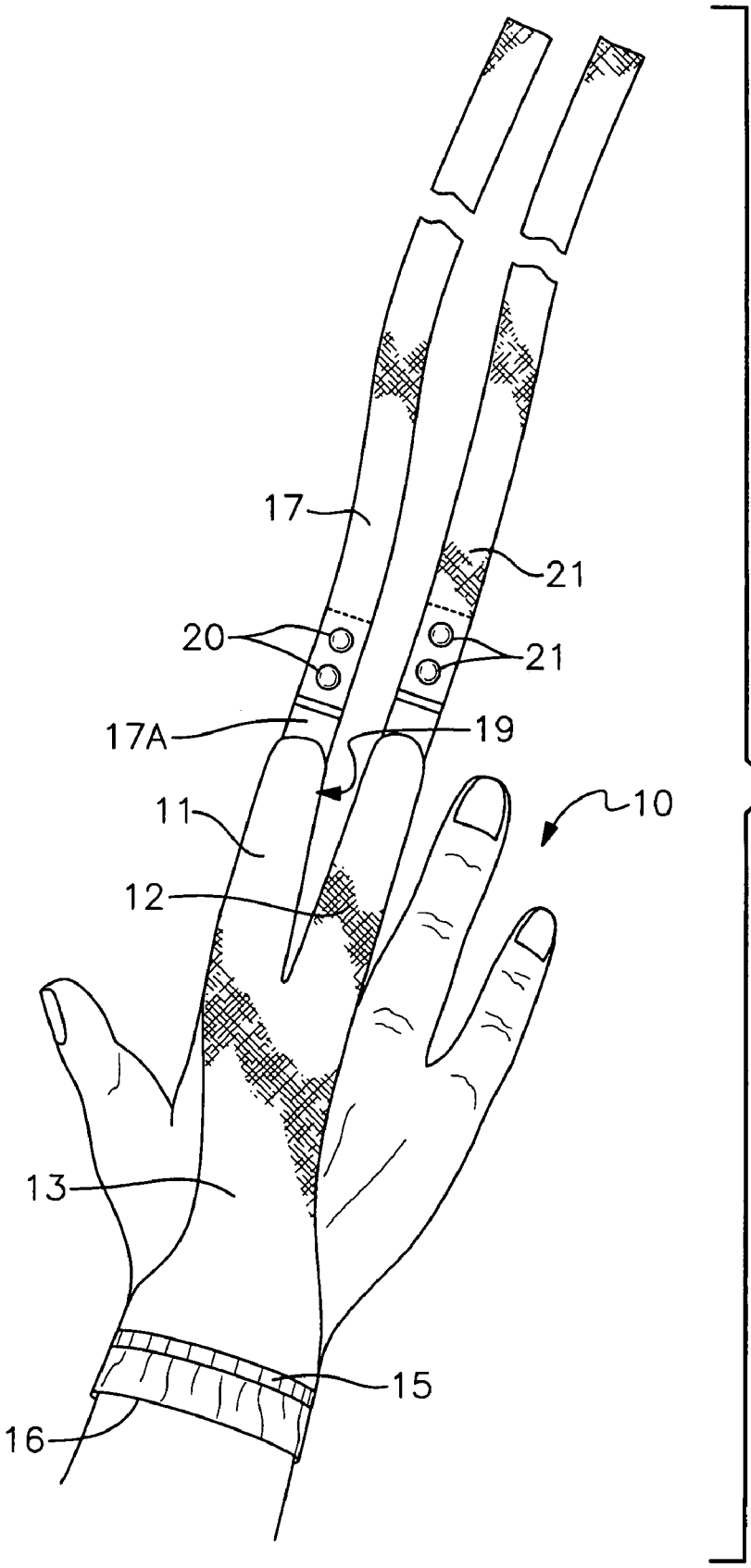
FIG. 6 is an enlarged perspective view of the training glove of the invention.
Figure 7:
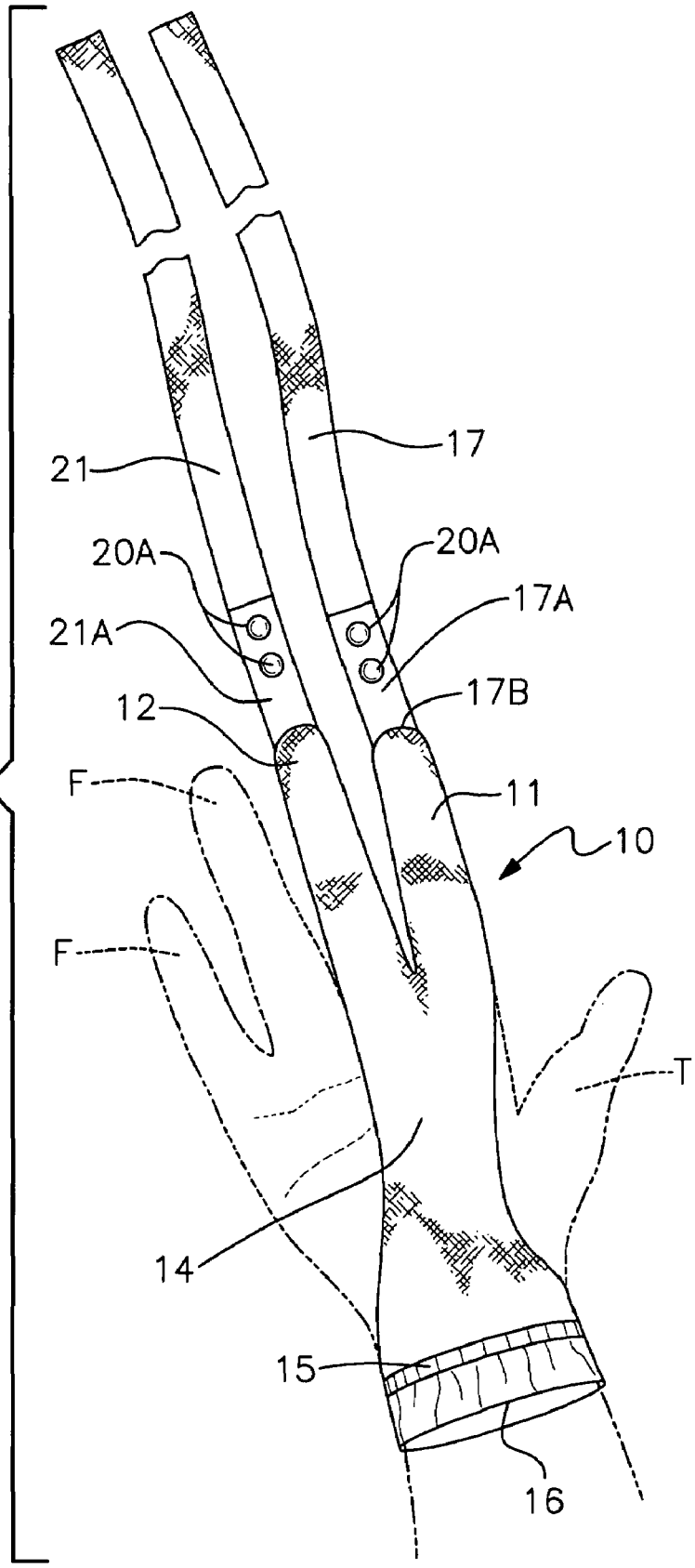
FIG. 7 is an enlarged perspective view of the palm side of the training glove of the invention.
Figure 8:
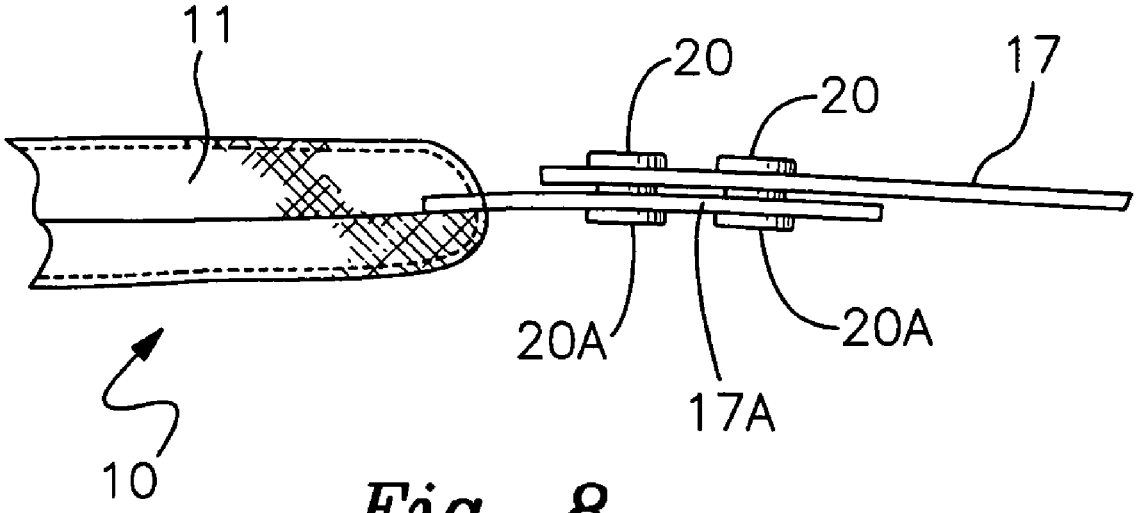
FIG. 8 is an enlarged side elevational view of the attachment tabs.

Referring now to FIGS. 6 and 7 of the drawings, a training glove 10 of the invention for teaching baseball pitching can be seen. The glove 10 has a pair of finger portions 11 and 12 and a backhand portion 13. A palm portion 14 interconnects the hereinbefore described finger portions with a preferably integral wrist engagement band insert 15 inwardly of the glove's open end at 16.

The finger portion 11 defined as the "index finger" has a position indicator band 17 of the invention removably secured on a finger extension tab 17A extending from an end tip portion 17B. The indicator band 17 is of an elongated flat flexible synthetic fabric material of extended length as will be described in greater detail hereinafter. The indicator band 17 is of a transverse dimension equal to that of the finger portion 11 from which it extends and is flexible, as noted, due to its extended length and the properties of the material from which it is made. The indicator band has an attachment fastener elements 20 thereon for selective registration to corresponding fastener elements 20A attached to the extension tab 17A.

A second indicator band 21 is removably secured on a finger extension tab 21A extending from an end tip 21B of the finger portion 12 adjacent that of the first "index" finger portion 11. The second indicator band 21 is of the same material and dimensional characteristics as of the first indicator band 17 as hereinbefore described with fastener elements 20 thereon for engagement with corresponding fastener elements 20A and are of an interlocking nature such as "snap" fasteners or alternately hook and loop material "Velcro"® or equivalent resealable fasteners, not shown.

Referring now to FIGS. 1-5 of the drawings, a training practice sequence is illustrated illustrating and detailing the critical steps and positions of the motions of a correct pitch using the improved training glove 10 of the invention by a player P.

Figure 1:
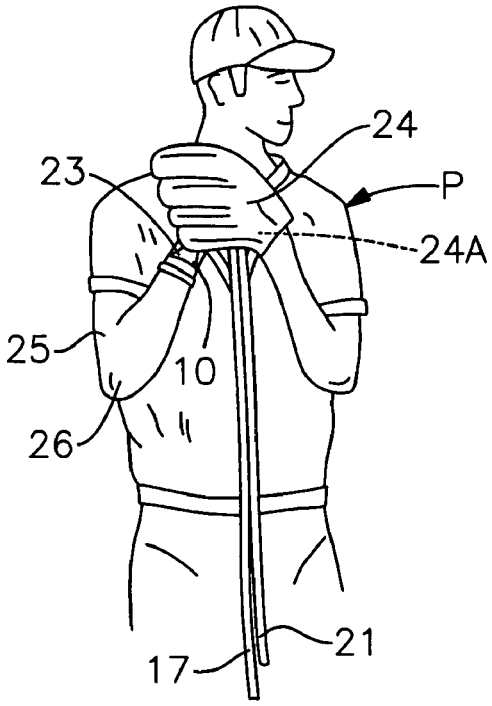
FIG. 1 is a perspective view illustrating the first indication position of the pitcher with the training glove of the invention.

In FIG. 1 of the drawings, a first position is illustrated as a hands together relaxed position with a pitching hand 23 is resting inside a baseball glove 24 on the glove hand 24A. The indicator bands 17 and 21 hang straight down along the center axis of the player's body B. The indicator bands 17 and 21 do not move which indicates and creates the proper balance that is needed on the rubber of a pitching mound (not shown).

Figure 2:
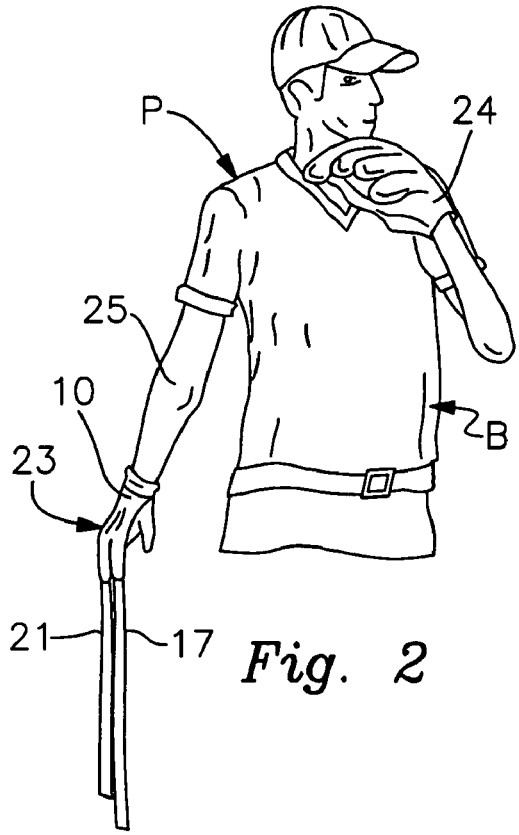
FIG. 2 is a perspective view illustrating the second indication position of a pitcher with the training glove.

FIG. 2 defines the "thumbs to thigh" position in which the indicator bands 17 and 21 will hand straight down from the pitching hand 23 with the palm portion 14 of the pitching hand 23 facing to the first base side of the field (not shown).

Figure 3:
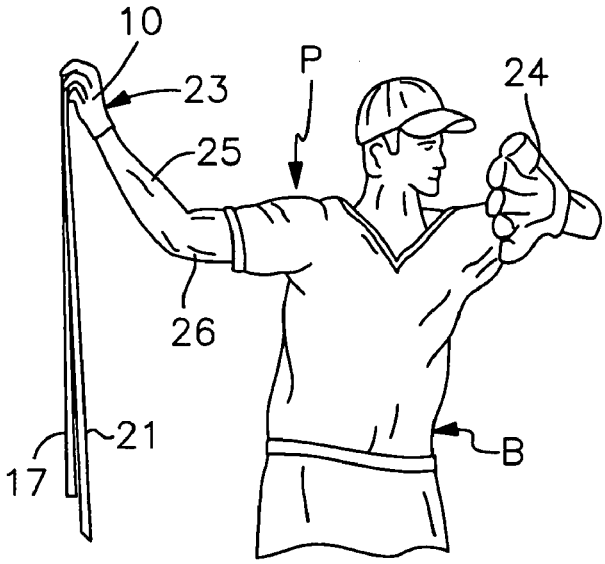
FIG. 3 is a perspective view of the third indicator position.

In FIG. 3 of the drawings, the pitching position step is illustrated of "knuckles high, gloves to the sky" in which the proper pitching arm 25 and pitching hand 23 position with the improved training glove 10 thereon is achieved wherein the indicator bands 17 and 21 will hang straight down with the player P elbow 26 bent so that the indicator bands 17 and 21 are approximately one to four inches in spaced relation from the elbow 26. This correct position, thus indicated by arrows, will allow the player P to rotate his pitching hand 23 at the proper position to lessen the chances of arm injury. If, for example, the indicator bands 17 and 21 land over the pitcher's arms 25 bicep portion (not shown) the player P in such position may cause injury.

Alternately, if the indicator bands 17 and 21 are not within the afore defined distance from the elbow portion 26 as illustrated by arrows, the pitching arm 25 would be improperly straight (not shown) thus causing the elbow 26 to drop below the shoulder causing increased strain on the pitcher's shoulder causing potential injury.

Figure 4:
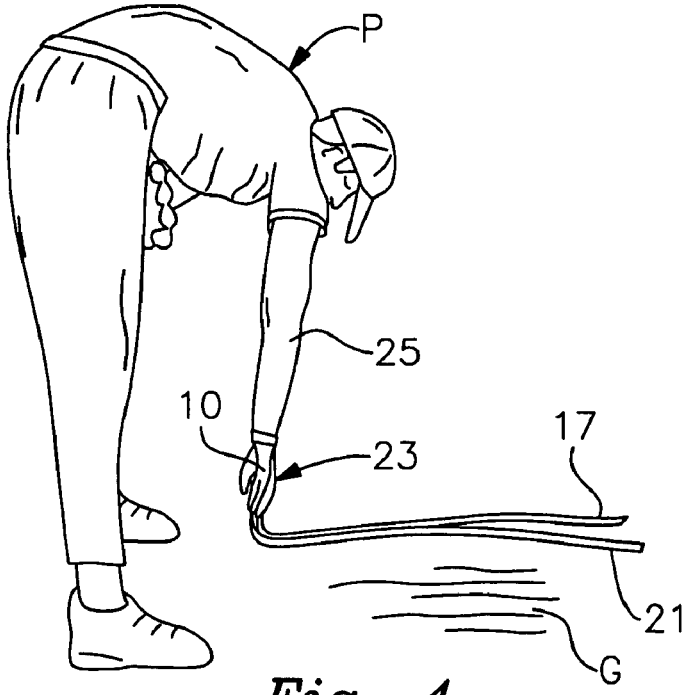
FIG. 4 is a perspective view of the fourth indicator position.

Referring now to FIG. 4 of the drawings, the arm motion of the pitch has simulated an indication of ball release and wherein the indicator bands 17 and 21 will engage "slap" the ground G forward of the pitcher with the "nose to toes, with eyes to the sky" position. The indicator bands 17 and 21 are now extended outwardly from the training glove 10 and on the ground G making a distinct slapping sound if proper positioning has been achieved at this functional point in the pitching motion.

Figure 5:
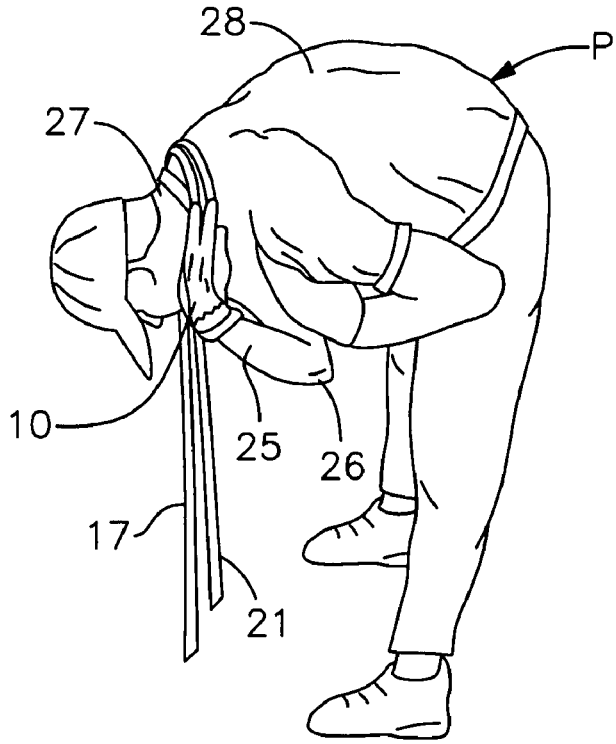
FIG. 5 is a perspective view of the fifth indicator position.

Referring now to FIG. 5 of the drawings, the proper follow-through is illustrated in which the indicator bands 17 and 21 must wrap somewhere around the player P's neck 27 as shown or upper back 28 to indicate proper follow-through has been achieved. If, for example, the indicator bands 17 and 21 do not stay on the neck 27 or the back 28 then the pitcher's arm 25 will whip back to the ground as in a so-called "bull whipping" known within the art causing potential arm injury. It will be evident that given the limited hand coverage afforded by the glove 10 of the invention that the player P's hand 23 will have exposed remaining fingers F and thumb T as noted.

Thus it will be seen that a new and novel training glove for pitchers has been illustrated and described and it will be apparent to those skilled in the art that various changes and modifications may be made therein without departing from the spirit of the invention.

I claim:

1. A baseball training glove for use in a method of teaching proper pitching techniques comprises, a glove body having a pair of finger portions, elongated flexible indicator bands extending freely from each of said tabs extending from said finger portion respectively, said indicator bands are of a length to hang freely from and beyond said finger portions when simulating a pitching action, said finger portions are each of a transverse dimension equal to that of said respective indicator bands, interengagement fasteners on said bands and tabs extending from said finger portions, a method of positioning said freely hanging bands extending from said finger portions in relation to a pitcher's body comprising the steps of, a. bring hands together chest high with indicator bands stationary hanging vertically, therefrom, b. pitching arm and hands extending straight downwardly with indicator bands extending therefrom with thumb position portions towards the pitcher's thigh and palm portion facing to the first base side, c. raising pitching arm and hand upwardly, with glove to the sky and indicator bands hanging vertically from the pitching hand, d. raising pitching arm upwardly, elbow bent, palm facing towards a second base with indicator bands hanging vertically in spaced relation to said elbow, e. indicator bands engaging the ground in front of the pitcher with portions of the pitching arm extending downwardly, "nose" pointing to toes and "eyes" looking to the sky, f. indicator bands wrapped around the pitcher's back and neck and hanging down with the pitching arm extending around the pitcher's body for follow through, said finger portions comprising an index finger portion and an adjacent finger portion.

* * * * *